United States Patent [19]

Johnson, Jr.

[11] Patent Number: 4,660,634

[45] Date of Patent: Apr. 28, 1987

[54] AUTOMATIC DRILL PIPE BREAKOUT

[75] Inventor: George P. Johnson, Jr., Tomball, Tex.

[73] Assignee: North Houston Machine, Inc., Tomball, Tex.

[21] Appl. No.: 746,349

[22] Filed: Jun. 19, 1985

[51] Int. Cl.[4] ..... E21B 19/16; B25B 13/50

[52] U.S. Cl. ..... 166/77.5; 81/57.34; 173/164

[58] Field of Search ..... 166/77.5, 377, 380, 166/78, 85; 175/203, 170, 52; 81/57.34, 57.35, 57.24, 57.4; 173/163–165

[56] References Cited

U.S. PATENT DOCUMENTS

| | | | |
|---|---|---|---|
| 2,969,702 | 1/1961 | Cornish et al. | 81/57.24 |
| 3,915,244 | 10/1975 | Brown | 166/77.5 |
| 4,147,215 | 4/1979 | Hodge et al. | 166/77.5 |

FOREIGN PATENT DOCUMENTS

| | | | |
|---|---|---|---|
| 2505986 | 8/1975 | Fed. Rep. of Germany | 173/164 |
| 0737614 | 6/1980 | U.S.S.R. | 173/164 |

*Primary Examiner*—Stephen J. Novosad
*Assistant Examiner*—David J. Bagnell
*Attorney, Agent, or Firm*—Pravel, Gambrell, Hewitt & Kimball

[57] ABSTRACT

Automatic drill pipe breakout torque is provided by a power sub or swivel. By connecting the drive pin of the power sub to the drill pipe in a non-threaded releasable manner the power sub is able to provide the breakout torque to breakout both threaded connections of a drill pipe segment. In geophysical or seismic drilling, a sliding barrel concentric with the drive pin releasable connects the drive pin to the drill pipe by engaging ridges on the pipe upsets with dogs on the barrel interior. The releasable non-threaded connection between the drive pin and the drill pipe segment allows breakout torque to be transmitted through the drill pipe segment after the threaded connection between the drive pin and the drill pipe segment has been partially broken out.

5 Claims, 4 Drawing Figures

AUTOMATIC DRILL PIPE BREAKOUT

FIELD OF THE INVENTION

The present invention relates to an apparatus to breakout drill pipe, such as geophysical or seismic drill pipe which includes exterior ridges on the pipe upsets, without the use of tongs or chains.

BACKGROUND OF THE INVENTION

In the drilling of shallow, small bore wells such as water wells, geophysical wells or seismic wells, the breakout of the pipe segments is a dangerous and time consuming process. The drilling of such wells typically is accomplished with a power sub or swivel rather than a rotary and kelly as employed in deep, oilwell drilling. The breakout of the drill string is accomplished by using wrenches to engage flats on the pipe upsets, chains or slips to control the rotation of a section of the pipe and power tongs or another wrench to rotate the pipe section to be broken out. The breakout operation is a time consuming and hazardous operation. Injuries to operators from the chain or rotating drill string are common because the operators must manually engage the drill pipe with wrenches and chains and are required to manually control rotation of a pipe segment during a breakout operation.

SUMMARY OF THE INVENTION

Briefly, the present invention relates to a new and improved breakout apparatus which allows the power sub in a water or geophysical drilling rig to be used to break out the drill pipe without the use of wrenches, chains or tongs. The drill pipe employed in the drilling of such wells is typically small diameter drill pipe having two diametrically opposed longitudinal ridges extending along the upsets of the box and pin segments.

The present invention allows the automatic control of a sliding barrel on a power sub which can engage the ridges on a drill pipe segment thereby connecting the segment to the drive pin of the power sub even when the threaded connection between the drive pin and corresponding box has already been broken. This allows the power sub to be employed to provide the rotational torque to break out the next connection in the drill string while the string is engaged by a slip. Upon break out of the next connection, the broken out pipe segment can be laid down or racked and the sliding barrel disengaged to allow rotation of the power sub drive pin to release the pipe segment from the power sub drive pin.

The sliding sleeve is preferably operated by a hydraulic cylinder mounted on the power sub, The present invention allows the breakout of drill pipe with the only manual action of the operator being locating the slips, and directing the broken out segment to a rack for storage. Engagement of the drill pipe such as by wrenches or chains is required and no manual rotational control such as by wrenches or tongs is required. The present invention greatly decreases the hazards involved in breaking out drill pipe. Further, the use of the power sub to provide the breakout torque obviates the need for a rotary and kelly, power tongs or wrenches and chains in such drilling operations.

DETAILED DESCRIPTION OF THE PREFERRED EMBODIMENT

Figure 1:
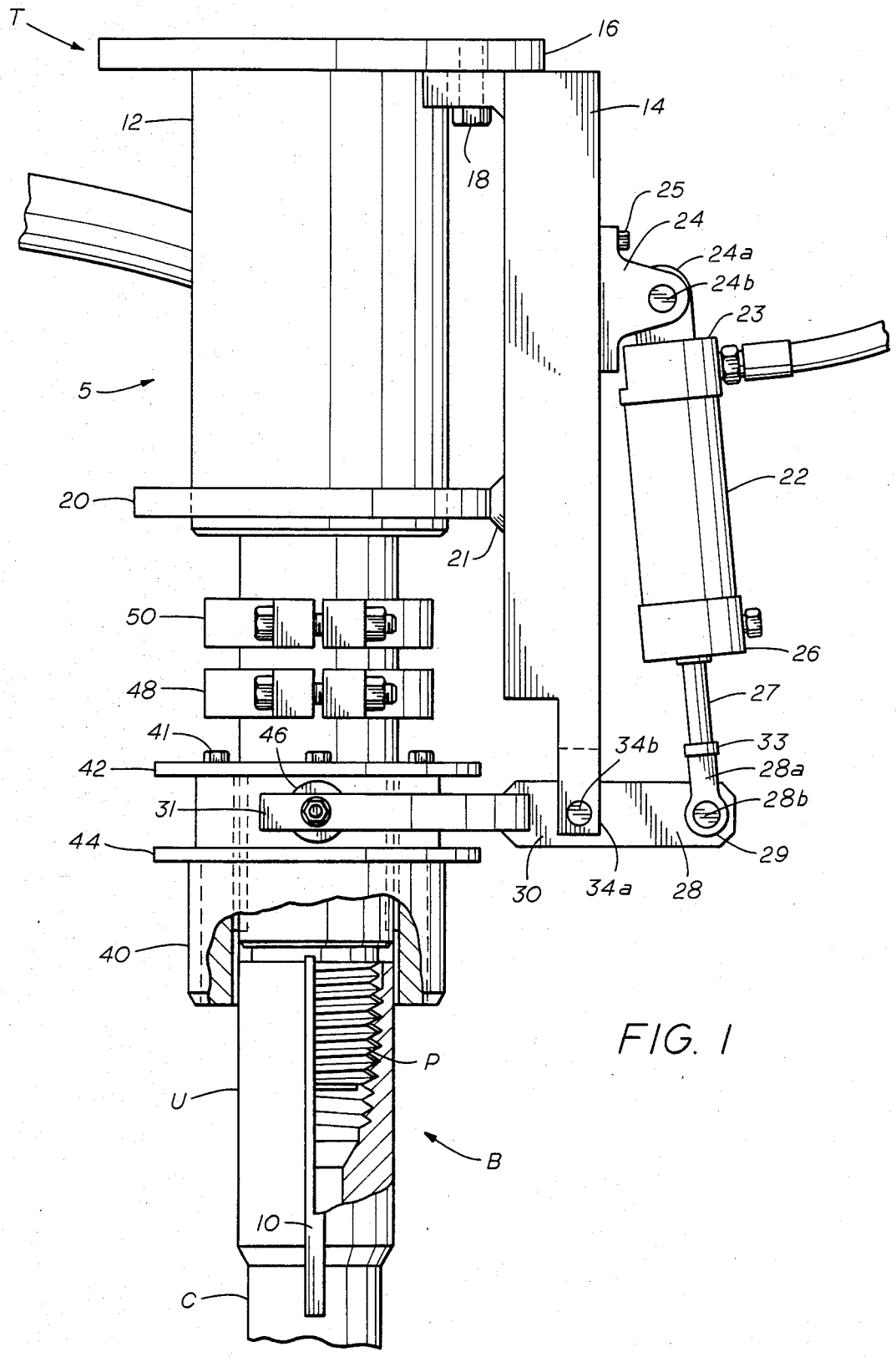
FIG. 1 is a side view, partially in cross-section, of the present invention showing the barrel engaging a drill pipe section.

The apparatus A of the present invention is mounted onto a power sub or swivel S adjacent the swivel body 12. The pivot arm 14 of the apparatus A is attached to the swivel body 12 by bolting the pivot arm 14 to a mounting ring 16. Mounting ring 16 encircles the swivel body 12 and is rigidly attached thereto by welding or the like. Mounting ring 16 is located on the swivel body 12 at the top end T, that is away from the drive pin P of the power swivel S. Pivot arm 14 is bolted to mounting ring 16 by a bolt 18 and extends from the attachment to the mounting ring longitudinally along the swivel body. A second brace ring 20 attached to pivot arm 14 by weld 21 or other suitable means, surrounds the swivel body 12 to support the pivot arm 14 in a position parallel the longitudinal axis of power sub S.

Supported by pivot arm 14 is a double acting hydraulic cylinder 22. One end 23 of hydraulic cylinder 22 is pivotally mounted to pivot arm 14 by a bracket 24. Bracket 24 can be bolted to pivot arm 14 by bolts 25 or can be permanently attached by welding or the like. The attachment of hydraulic cylinder 22 to bracket 24 is a pivotal interconnection such as by a clevis **24*a* and pin 24*b* to allow hydraulic cylinder 22 to freely pivot about end 23**.

The opposite end 26 of hydraulic cylinder 22 through piston 27 is attached to the foot 29 of a "Y" shaped shift arm 28. The attachment of hydraulic piston 27 of hydraulic cylinder 22 to shift arm 28 is a pivotal attachment such as by a clevis **28*a* and pin 28*b* arrangement. The piston 27 of hydraulic cylinder 22 further includes adjustment means 33 to allow alteration of the length of piston 27**.

Shift arm 28 is pivotally attached to pivot arm 14 at the base 30 of the "Y" shape. The shift arm 28 pivots about a pin **34*b* which extends through a clevis 34*a* arrangement in pivot arm 14. The movement of piston 27 by hydraulic cylinder 22 thus causes a longitudinal movement of the yoke portion 31 of shift arm 28. The yoke portion 31 of shift arm 28** extends concentrically, partially around the drive pin P attached to power sub S.

Concentric with pin P is a locking barrel 40. Locking barrel 40 has an internal diameter such that it will freely slide longitudinally over the drive pin P of power sub S and the upset U of the box section B of a drill pipe segment C. Extending radially outward from the barrel 40 are two rings 42 and 44. The rings 42 and 44 are located near the top 41 of barrel 40 in a position such that the yoke 31 of shift arm 28 is oriented between rings 42 and 44. A suitable low friction attachment such as a bearing 46 is provided between shift arm 28 and rings 42 and 44 of barrel 40. Thus, barrel 40 can freely rotate with the drive pin P and can be oriented longitudinally along the power sub S by the action of shift arm 28 controlled by hydraulic cylinder 22.

Figure 2:
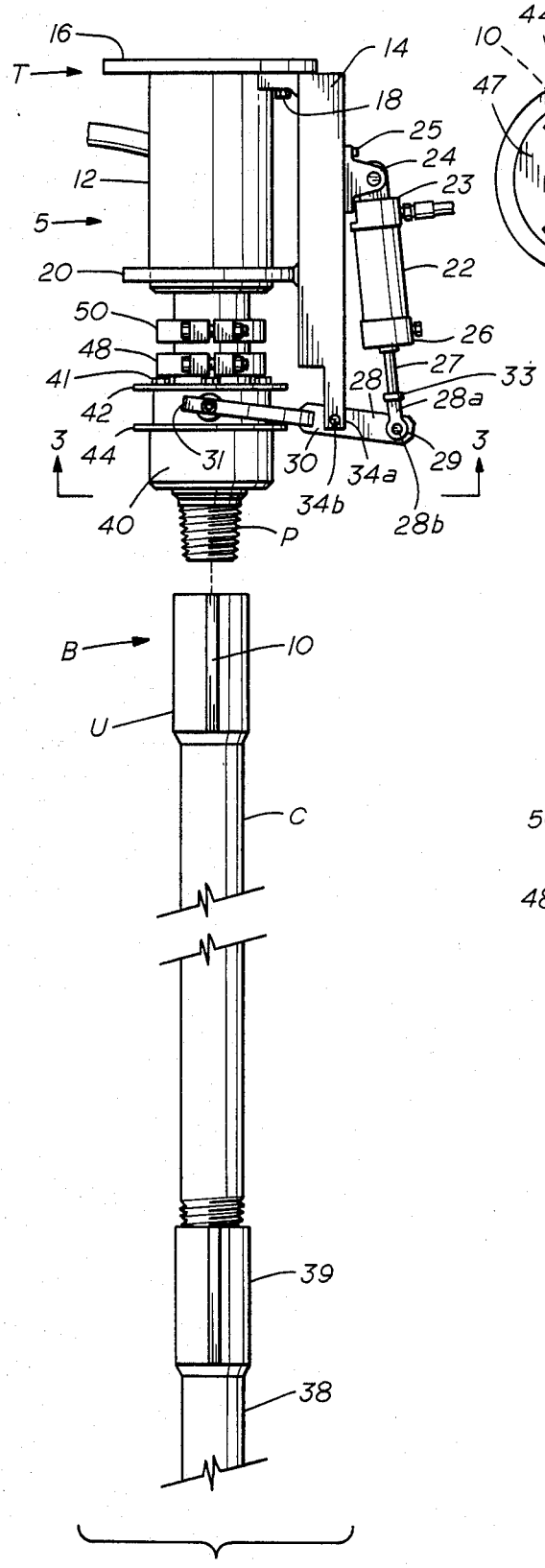
FIG. 2 is a side view, partially in cross-section, of the present invention showing the barrel disengaged from the pipe section.
Figure 3:
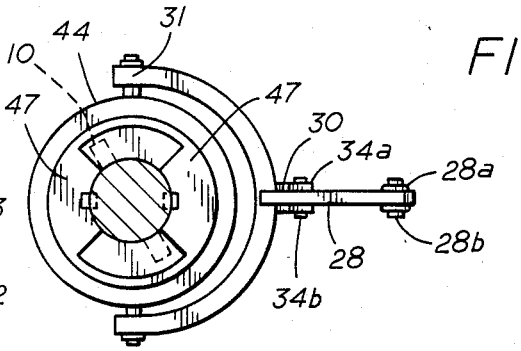
FIG. 3 is an end view of the present invention along line 3—3 of FIG. 2.

Suitable clamps 48 and 50 are used to lock the drive pin P to the power sub S and further to act as stops for the travel of barrel 40 over the drive pin P (FIG. 2).

The internal diameter of barrel 40 includes two dogs 47 to contact the ridges 10 on the upsets U of the drill pipe C. Dogs 47 also contact the ridges on the drive pin P. When a segment of drill pipe C is threaded upon drive pin P, barrel 40 can be automatically moved longitudinally along drive pin P through the action of hydraulic cylinder 22. The dogs 47 contact ridges 10 on the box section B of the drill pipe C to rigidly connect the drill pipe to the drive pin P even when the threaded connection between the drive pin P and drill pipe C is not completely torqued down.

In practice, the apparatus of the present invention allows the breakout of drill pipe segments without the use of wrenches, chains or tongs by allowing power sub S to provide the required breakout torque. The breakout operation employs a pair of slips (not shown) to lock the lower end of the drill string in position relative to the rig floor.

To break out a section of drill pipe, the drill string is supported and locked by slips in a manner as would be known to those skilled in the art. The barrel 40 is oriented in a release position (FIG. 2) by extending piston 27 of hydraulic cylinder 22. The power sub is then activated to partially break the threaded connection between the drive pin P and the drill pipe C. Drive pin P is rotated a small number of turns so that the connection while loose will still support the drill string. The hydraulic cylinder is activated to retract piston 27 which causes shift arm 28 to pivot at its connection to the pivot arm 14 and the yoke 31 slides barrel 40 longitudinally along drive pin P. Barrel 40 slides over the upset U on the box portion B of the drill pipe C such that dogs 47 of barrel 40 engage the ridges 10 on upset U. The dogs 47 connect the drill pipe section C to power sub S. The power sub is raised, raising the drill string until the next pipe connection 39 to be broken out is exposed. The slips are located to grip the drill string 38 below the connection to be broken out and power sub S is activated to completely break out and release the threaded connection. The dogs 47 of barrel 40 allow the torque from the power sub S to be transmitted to the drill pipe even when the threaded connection between the drive pin P and the drill pipe C is loose. The released section of drill pipe is located in a rack or laid down for storage. Hydraulic cylinder 22 is activated to extend piston 27 thereby sliding barrel 40 up the drive pin P releasing the dogs 47 from ridges 10 of the drill pipe C. The section of drill pipe can then manually be unthreaded from the drive pin S without using spinning chain, wrenches or other tools to rotate the pipe because the threaded connection has already been broken. The power sub S is lowered to engage the next section of drill pipe held by slips. The drive pin P is partially threaded into the box portion B of the next drill pipe segment 38 and hydraulic cylinder 22 activated so that barrel 40 slides to connect the partially threaded drill pipe section to the drive pin. The drill string is raised, slips engaged below the next connection to be broken and the process repeated.

The sliding barrel 40 activated by hydraulic cylinder 22 allows the breaking out of drill pipe sections without the use of chains, wrenches or tongs. The process can be controlled from a remote panel (not shown) and the only manual action necessary being locating of the slips and directing the broken out pipe segments to a rack. This greatly increases the safety of the breakout operation by avoiding manually rotating a drill pipe section either with wrenches or chains.

Figure 4:
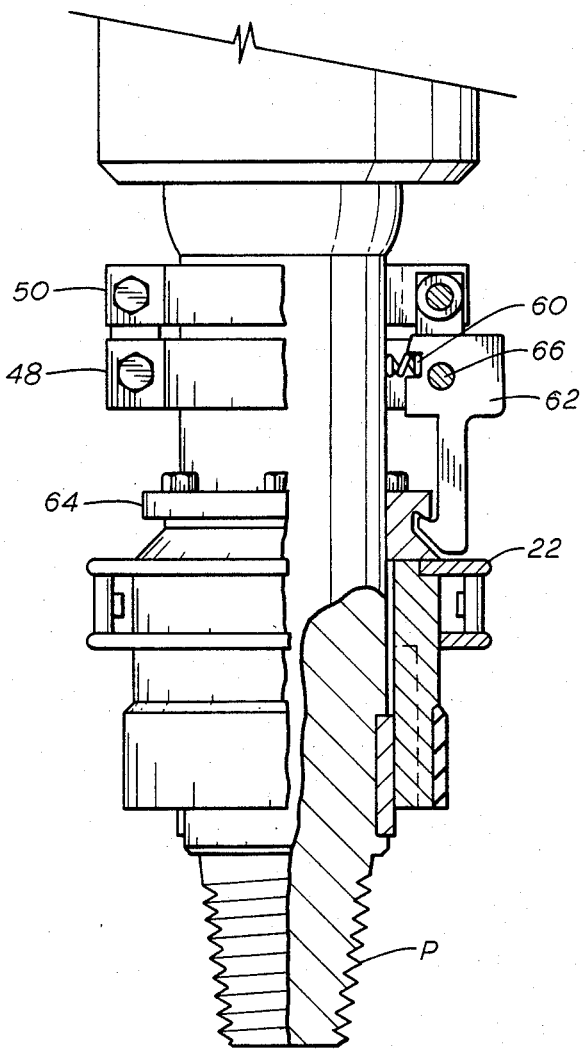
FIG. 4 is a side view, partially in cross-section, of an alternate embodiment of the present invention.

FIG. 4 illustrates an alternative embodiment of the present invention which makes use of a spring 60 loaded latch 62 to hold barrel 22 in its up position in place of the hydraulic cylinder. The barrel ring 42 is replaced by a latch ring 64 which engages latch 62 when the barrel is raised to a release position. The latch 62 is held in a locked position by spring 60 and pivots about pin 66. The operation of the manual embodiment is the same as discussed above with respect to the hydraulically activated embodiment except that barrel 40 is lowered by releasing latch 60 manually to connect the drill pipe segment to the drive pin P and raised manually to release the drill pipe by engaging latch 62. The manual embodiment obviates the use of chains or wrenches to control pipe rotation while being suitable for use on drilling rigs where hydraulic power is not available.

The foregoing disclosure and description of the invention are illustrative and explanatory thereof, and various changes in the size, shape and materials, as well as in the details of the illustrated construction may be made without departing from the spirit of the invention.

I claim:

1. A drill pipe breakout apparatus which is employed with a power sub during breakout operations which comprises:

(a) a sliding barrel concentric with the drive pin of the power sub to releasably connect drill pipe segments to the drive pin through the contact of dogs with said barrel with longitudinal ridges on said drill pipe;

(b) a shift arm connected to said sliding barrel; and (c) hydraulic cylinder means connected to said shift arm and to the body of the power sub for selectively moving said barrel from a drill pipe connecting position to a drill pipe of released position.

2. The apparatus of claim 1 wherein said shift arm comprises a central pivotal connection and a first end pivotally connected said hydraulic cylinder and a second end connected to said barrel.

3. The invention of claim 2 wherein said second end of said pivot arm is connected to said barrel by means of a yoke having rollers at its ends which engage a groove on said barrel to allow rotation of said barrel relative to said yoke.

4. A drill pipe breakout apparatus which is employed with a power sub to provide automatic breakout which comprises:

(a) a threaded pin driven by a power sub;

(b) a sliding barrel substantially encircling the driven pin and having lugs on the interior of said sliding barrel for engaging longitudinal ridges on drill pipe to releasably connect the drill pipe to said pin;

(c) hydraulic cylinder means mounted on a pivot arm attached to said power sub for sliding the sliding barrel selectively from a drill pipe connecting position to a drill pipe release position and clamp means for releasably attaching means to the power sub and said sliding barrel.

5. The apparatus of claim 4, wherein said pivot arm includes a yoke with roller means thereon for engaging a groove on said barrel for allowing rotation of said barrel with said driven pin while being slidably movable relative to the driven pin of the power sub.

* * * * *